US006164771A

United States Patent [19]

Eckard et al.

[11] Patent Number: 6,164,771

[45] Date of Patent: Dec. 26, 2000

[54] COMPACT PRINT CARTRIDGE WITH OPPOSITELY LOCATED FLUID AND ELECTRICAL INTERCONNECTS

[75] Inventors: B Michael Eckard, Cardiff, Calif.; Jose Antonio Alvarez, Alcorcon, Spain; Jeffrey T Hendricks, Camas, Wash.; James P. Kearns, Corvallis, Oreg.; Kenneth R Williams, Vancouver, Wash.; Norman E Pawlowski, Corvallis, Oreg.; Ted Lee, San Diego, Calif.

[73] Assignee: Hewlett-Packard Company, Palo Alto, Calif.

[21] Appl. No.: 09/431,710

[22] Filed: Oct. 31, 1999

[51] Int. Cl.[7] ..... M41J 2/175

[52] U.S. Cl. ..... 347/86

[58] Field of Search ..... 347/85, 86, 87, 347/50

[56] References Cited

U.S. PATENT DOCUMENTS

| | | | |
|---|---|---|---|
| 5,367,328 | 11/1994 | Erickson | 347/7 |
| 5,461,482 | 10/1995 | Wilson et al. | 347/50 |
| 5,841,452 | 11/1998 | Silverbrook | 347/47 |

FOREIGN PATENT DOCUMENTS

| | | | |
|---|---|---|---|
| 61-12347A | 1/1986 | Japan | 347/86 |

*Primary Examiner*—N. Le
*Assistant Examiner*—Anh T. N. Vo

[57] ABSTRACT

An inkjet print cartridge having minimized size dimensions and capable of removable installation in a carriage. In a preferred printer environment a plurality of such print cartridges are mounted in a carriage, with each print cartridge holding a different type/color of liquid to be applied to a media material. Liquid replenishment is provided through a liquid interconnect and control signals are provided through an electric interconnect, which are respectively positioned in spaced apart locations on opposite sides of the print cartridge.

22 Claims, 17 Drawing Sheets

COMPACT PRINT CARTRIDGE WITH OPPOSITELY LOCATED FLUID AND ELECTRICAL INTERCONNECTS

RELATED APPLICATIONS

This is a continuation-in-part of commonly assigned co-pending application Ser. No. 08/706,045 filed Aug. 30, 1996 entitled "Compliant Ink Interconnect Between Print Cartridge And Carriage" by Norman Pawlowski, Jr. et al., which is a continuation-in-part of U.S. patent application Ser. No. 08/550,902 filed Oct. 31, 1995, entitled "Apparatus For Providing Ink To An Ink-Jet Print Head And For Compensating For Entrapped Air" by Norman Pawlowski, Jr. et al., now U.S. Pat. No. 5,872,584, which is a continuation-in-part of U.S. patent application Ser. No. 08/518,847 filed Aug. 24, 1995, entitled "Pressure Regulated Free-Ink Ink-Jet Pen," by Norman Pawlowski, Jr. et al., now U.S. Pat. No. 5,736,992, which is a continuation-in-part of U.S. patent application Ser. No. 08/331,453 filed Oct. 31, 1994 entitled "Ink Level Detection In A Pressure Regulated Pen", by Norman Pawlowski et al., now U.S. Pat. No. 5,583,545, all of which are incorporated herein by reference.

This application relates to the subject matter disclosed in commonly assigned co-pending U.S. patent application Ser. No. 09/431,709, filed Oct. 31, 1999 entitled "Pivoted Printhead Handle With Recessed Rest Position" by B. Michael Eckard et al.; U.S. patent application Ser. No. 09/431,712, filed Oct. 31, 1999 entitled "Datum Structure For Compact Print Cartridge" by Kenneth R. Williams et al.; U.S. patent application Ser. No. 09/431,711, filed Oct. 31, 1999 entitled "Unitary Latching Device For Secure Positioning Of Print Cartridge During Printing, Priming And Replenishment" by Tod S. Heiles et al.; and U.S. patent application Ser. No. 08/878,489 filed Jun. 18, 1997 entitled "Inkjet Pen Alignment Mechanism And Method" by Kenneth R. Williams et al., all of which are incorporated herein by reference.

BACKGROUND OF THE INVENTION

Various problems present themselves in design of current inkjet printers, Modem inkjet printers print at very high resolution, for example, 600 or even 1200 dots-per-inch (DPI). As resolution in s droplet size typically decreases. With increased resolution and decreased dot size, it becomes more important that the pens be precisely located in the carriage. To accomplish accurate positioning of the pen in the carriage, the pen typically has a set of physical X, Y, and Z datums that are seated against a corresponding set of datums in the carriage stall.

Modem inkjet printers typically print in color and have a plurality of color pens, usually printing in cyan, magenta, yellow, and black. It is often desirable to provide a different pen for each color, so that if a single pen goes bad, only that pen need be replaced. However, each pen must be precisely aligned with the other colors, or the print quality of the printed images will be degraded. Therefore, the system must not only accommodate precision placement of the pens in the stalls, but precise alignment among the colors.

In addition to the mechanical positioning of the pens within the carriage, the pens must be fluidically connected to trailing tubes. The pens usually interface with some type of valve on the ends of the tubes. The pens make connection with these valves when they are inserted into the carriage stall. However, if the pen and valve interface is not correctly designed, the forces exerted on the pen during fluid interconnection will counteract the precision positioning of the datums, resulting in the pens being misaligned. The fluid interconnection mechanism must be designed so as to not act against the precise positioning resulting from the interaction of the datums.

Recent advances in printhead construction have allowed printheads to be designed to be a permanent or semi-permanent part of the printer, with separate ink cartridges that are fluidically connected in some fashion to the printhead.

Although the pens are preferably a permanent fixture in the printer, rather than being disposable, it is likely that many such pens will fail before the end of the life of the printer. Therefore, some provision must be made so that the pen can be removed and replaced with a new one. The mechanical datum system and fluid interconnect must also allow the new pen to be reliably and precisely positioned during such replacement. The system would be preferably designed so that installation and subsequent replacements could be done by a purchaser or by a field repair person away from factory conditions.

SUMMARY OF THE INVENTION

The invention provides an inkjet printing mechanism designed to receive an ink jet pen having a needle and a shroud surrounding the needle, the shroud attached to the pen by means of a neck, the pen also having pen dank configured for positioning the pen within a printer carriage. The printer includes a printer chassis and a media movement mechanism mounted to the chassis and constructed to position a print medium in a print zone. A carriage is mounted to the chassis and is constructed to receive the pen and to position the pen over the print zone. The carriage has a notch configured to receive the neck when the stall receives the pen. A valve is movably attached to the carriage and is configured to move with respect to the carriage to be received by the shroud when the notch receives the neck. A septum is positioned on the valve and configured such that when the valve is received by the shroud, the septum is pierced by the needle. A set of carriage datums is formed in the stall and configured to interface with the pen datums. A latching mechanism is associated with the carriage and constructed to seat the pen datums against the carriage datums to finely position the pen with respect to the carriage.

The invention thus provides for reliable insertion of inkjet pens within their respective carriage stalls, with successive guiding mechanisms for aligning various parts of the pen with corresponding parts of the carriage.

In the preferred embodiment, an inkjet printer includes a replaceable print cartridge which is inserted into a scanning carriage. An ink tube extends from the scanning carriage to a separate ink supply located within the printer. A fluid interconnect on the print cartridge connects to a fluid interconnect on the carriage when the print cartridge is inserted into the carriage to complete the fluid connection between the external ink supply and the print cartridge. In one embodiment, the fluid interconnection is made between the print cartridge and the ink tube simply by placing the print cartridge into a stall in the scanning carriage. A pressure regulator, which may be internal or external to the print cartridge, regulates the flow of ink from the external ink supply to the print cartridge. The external ink supply may be pressurized or non-pressurized.

A compact inkjet print cartridge is provided with minimized size dimensions and capable of removable installation in a carriage. In a preferred printer environment a plurality of such lower weight print cartridges are mounted in a carriage, with each print cartridge holding a different type/ color of liquid such as ink or other suitable liquid to be applied to a media material. Liquid replenishment is provided through a liquid interconnect and control signals are provided through an electric interconnect, which are respectively positioned in spaced apart locations on opposite sides of the print cartridge.

DETAILED DESCRIPTION OF THE ILLUSTRATED EMBODIMENTS

Figure 1:
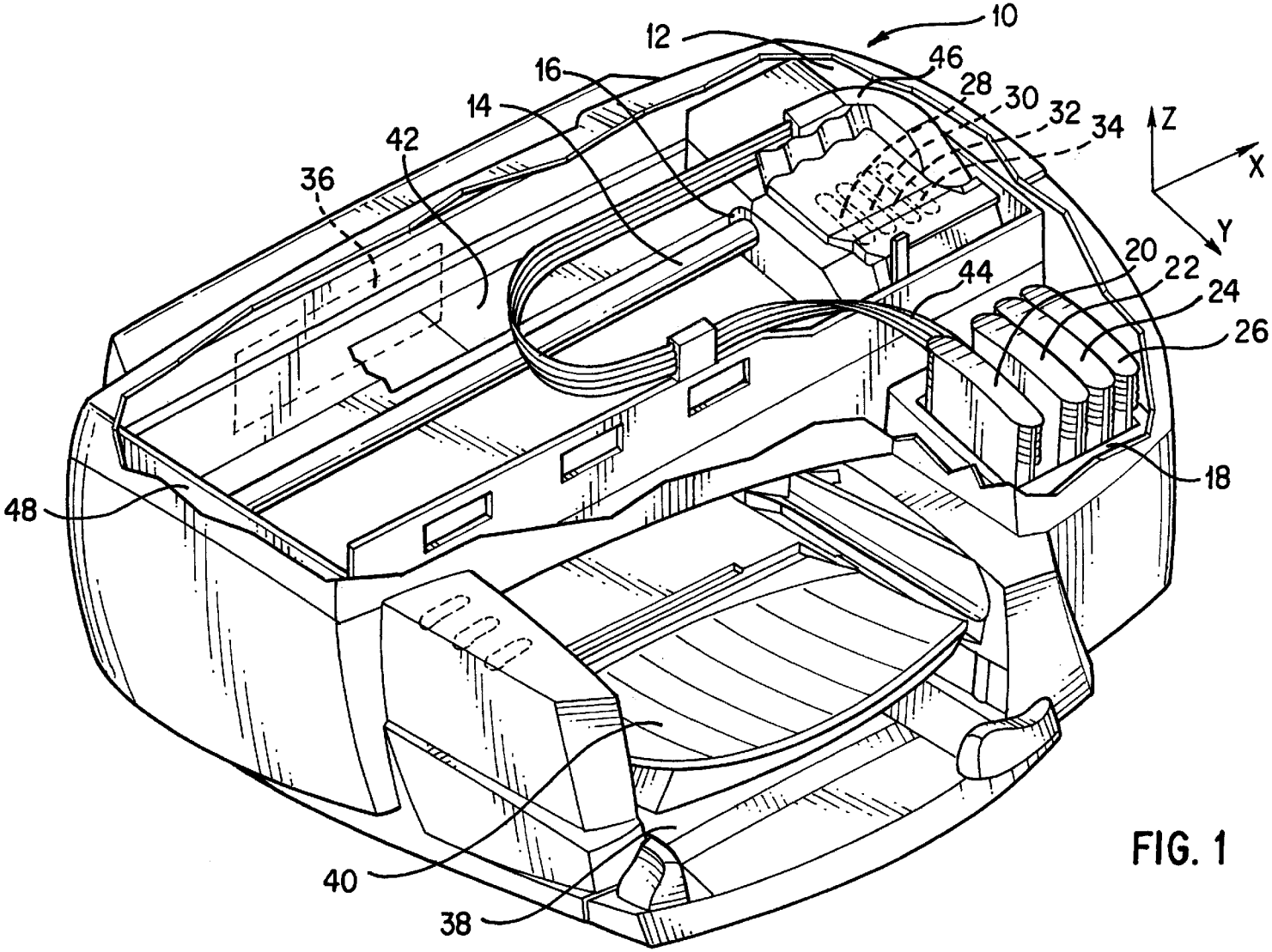
FIG. 1 is a perspective view of an inkjet printer having an ink replenishment system for multiple printheads removable mounted in a carriage.

FIG. 1 is a cutaway view of a printer 10 of the invention. Printer 10 includes a chassis 12, carriage rod 14, carriage 16, ink cartridge stall 18, ink cartridges 20, 22, 24, 26, printheads (pens) 28, 30, 32, 34 (shown in outline), controller 36 (shown in outline), input tray 38, and output tray 40. Controller 36 communicates with pens 28, 30, 32, 34 by means of a flex strip 42, in a manner well known in the art. Ink cartridge 20 holds black ink, cartridge 22 holds cyan ink, cartridge 24 holds magenta ink, and cartridge 26 holds yellow ink. Similarly pen 28 prints black dots, pen 30 prints cyan dots, pen 32 prints magenta dots, and pen 34 prints yellow dots. Ink is fed from ink cartridges 20, 22, 24, 26 to pens 28, 30, 32, 34 by means of tube assembly 44. Tube assembly 44 connects with manifold 46, and inside manifold 46 the individual tubes carrying the four colored inks are separately routed to their respective valving mechanisms so that ink can be fed to the pens. Carriage 16 is shown in FIG. 1 in its "home" position at the right side of the print zone. The print zone resides between this home position and the left side 48 of chassis 12.

Carriage 16 rides along carriage rod 14 and traverses in the direction labeled X back and forth to thereby scan the pens across the print zone as dots are laid down on the page in a dot matrix pattern. For this reason, the direction X is commonly referred to as the carriage axis or scan axis.

After a print swath is complete, the paper or other print media is incrementally moved in the direction labeled Y, so that another print swath can be printed. Subsequent contiguous swath are printed to print entire pages of text or images in a manner well known in the art. The direction orthogonal to directions X and Y will be referred to herein as the Z axis. After a page of information is printed, the page is ejected onto the output may 40, and and a new sheet is "picked" from the input tray so that it can be printed on.

In one embodiment, the printhead cartridge has an overall height dimension which is approximately 50 mm or less. The printhead cartridge has an overall width of 16 mm or less.

Figure 3:
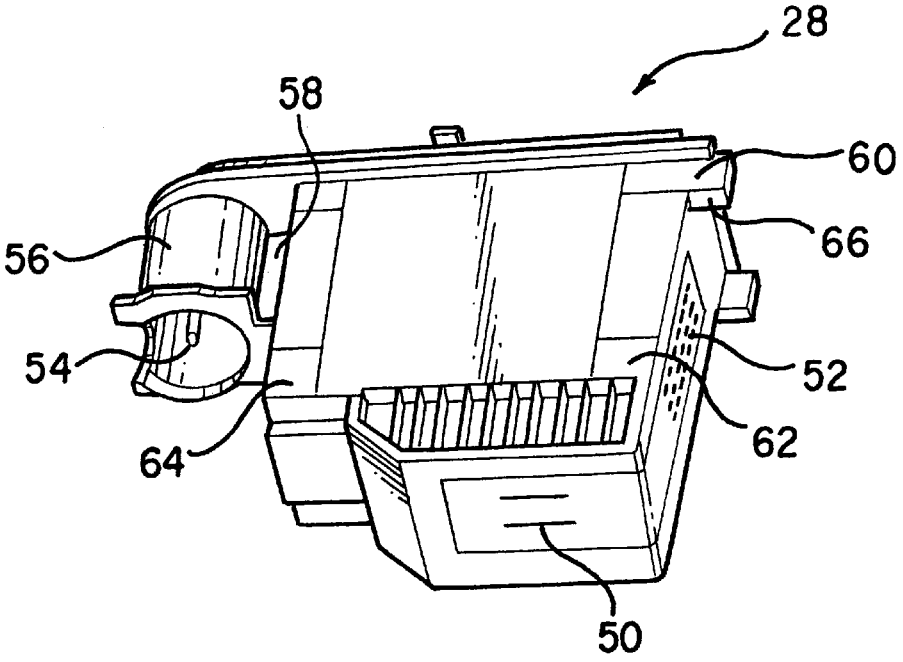
FIGS. 3 and 4 are bottom perspective views of one version of a print cartridge incorporating features of the invention.
Figure 4:
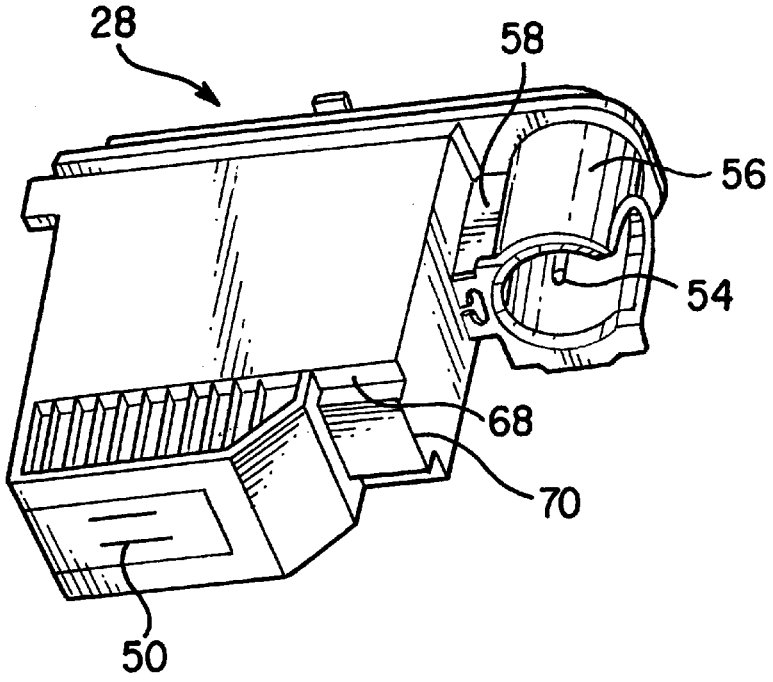

FIGS. 3 and 4 illustrate pen 28 in detail, and is typical of pens 28, 30, 32, 34. This pen includes printhead nozzles 50, electrical interconnect pads 52, fluid interconnect needle 54, shroud 56, and neck 58. Pen 28 bas X datum 60, 62, 64; Z datums 66 and 68; and Y datum 70. Contact pads 52 interface with a set of matching contact pads in the printer so that the printer can provide firing signals to the pen.

In an exemplar embodiment, the approximate weight of the printhead cartridge is approximately 50 grams or less.

Based on these firing signals, droplets are ejected from nozzles 50. Needle 54 interfaces with a septum, described later, to provide a supply of ink to the pen. Shroud 56 covers and protects needle 54. Both shroud 54 and neck 58 serve to guide the needle into its interface with its septum. These functions are described more completely below.

Figure 2:
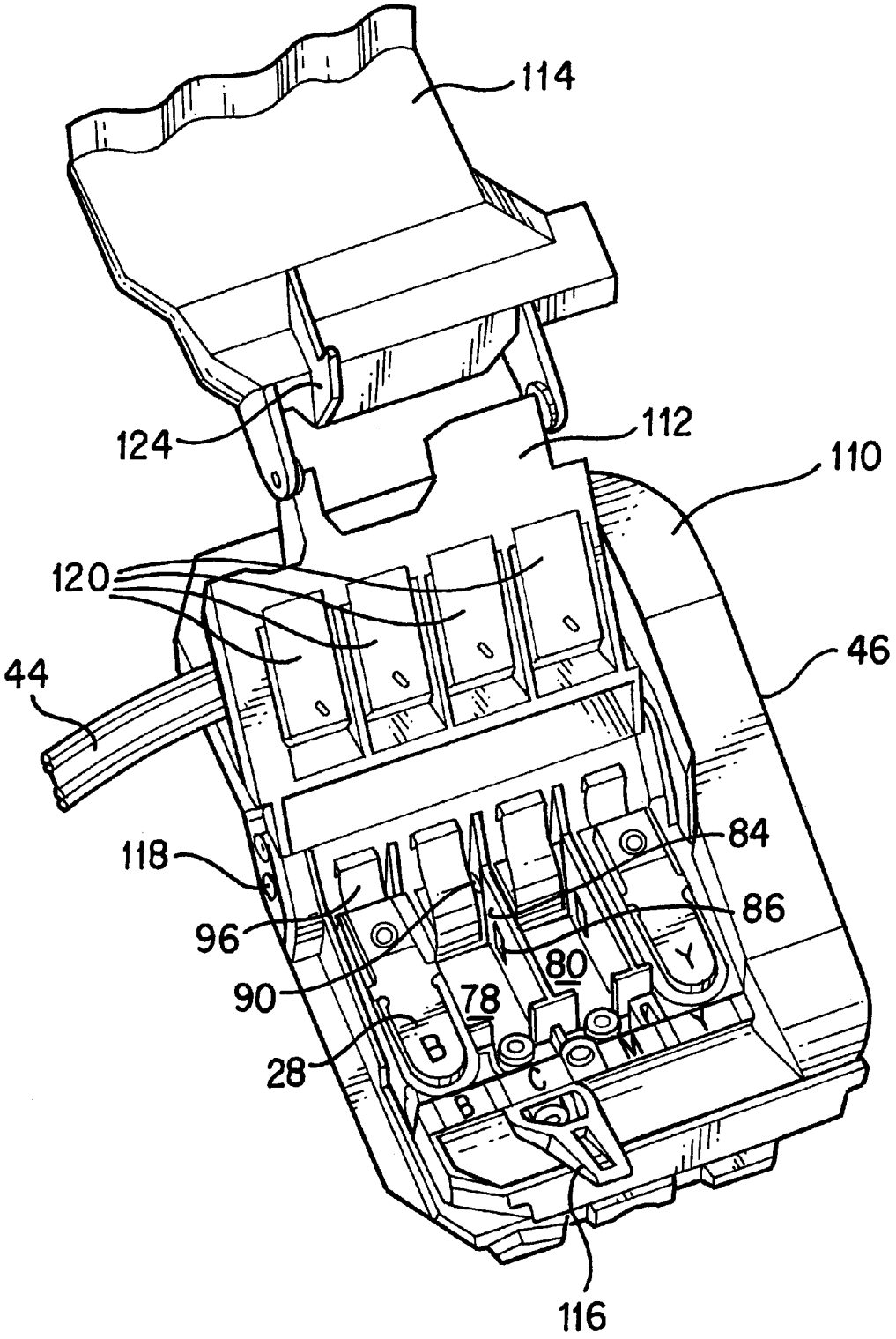
FIG. 2 shows one embodiment of a carriage for mounting print cartridges incorporating features of the invention, with a latching device in open position, and black and yellow print cartridges in the carriage chutes with their print cartridge handles down.
Figure 5:
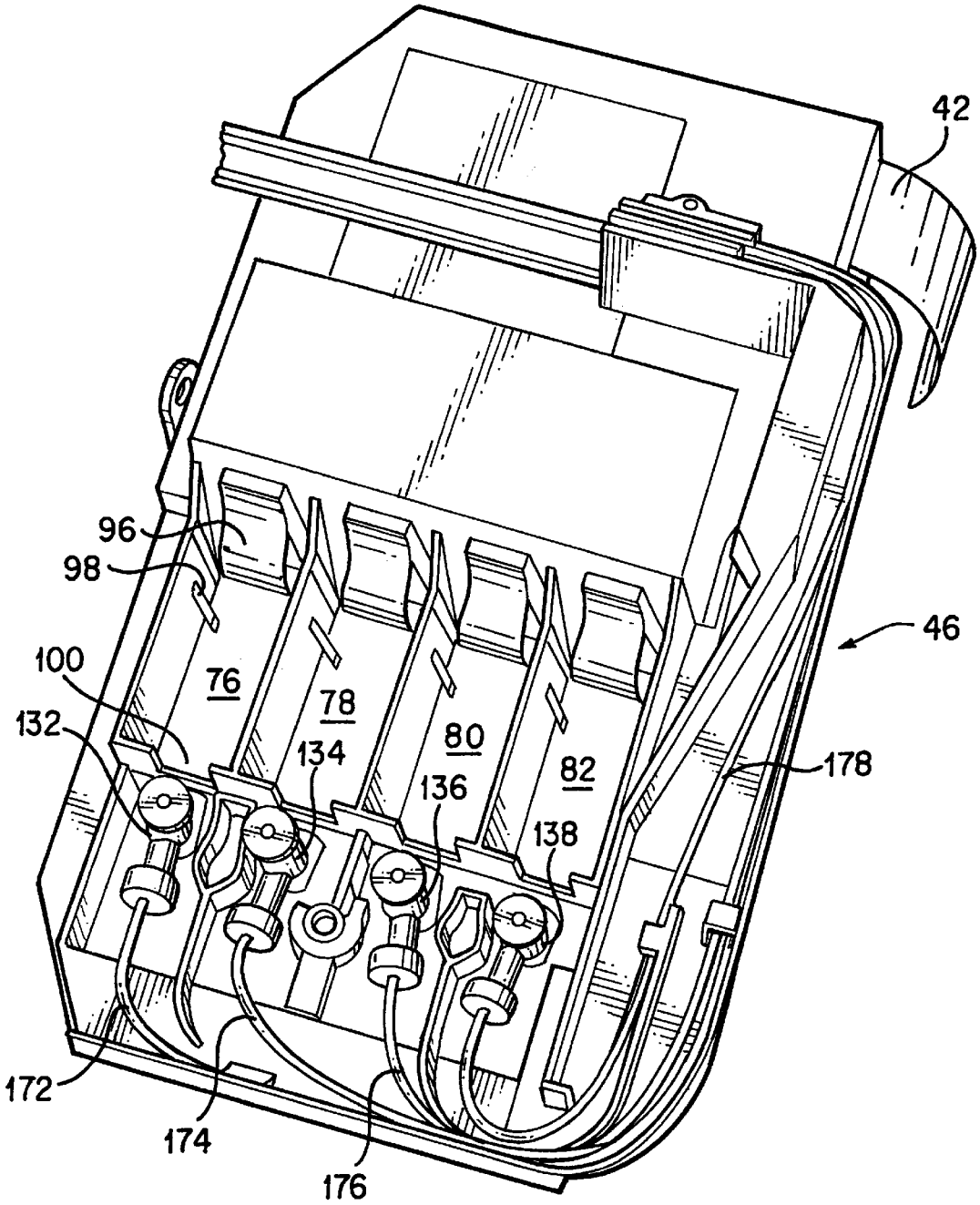
FIG. 5 is a partially cut-away top view of the carriage with the print cartridges removed, showing the ink replenishment tube routing.
Figure 6:
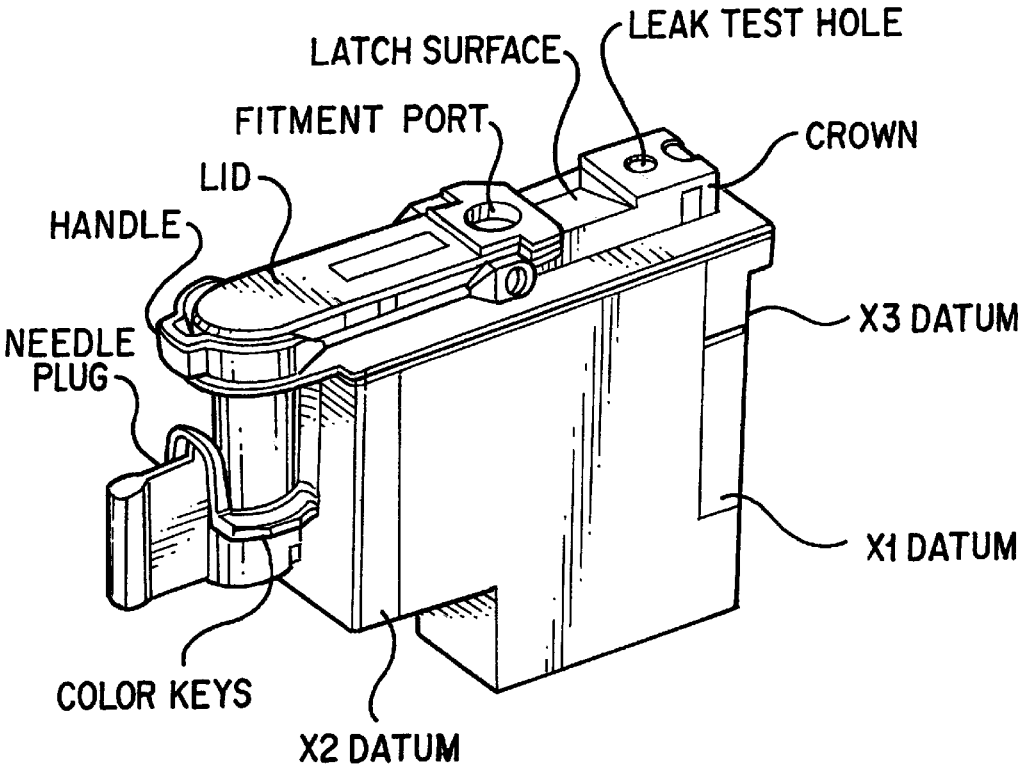
FIG. 6 is a top perspective view of a recent print cartridge embodiment showing the crown with the print cartridge handle down, and with a removable plug over the needle inlet.
Figure 7:
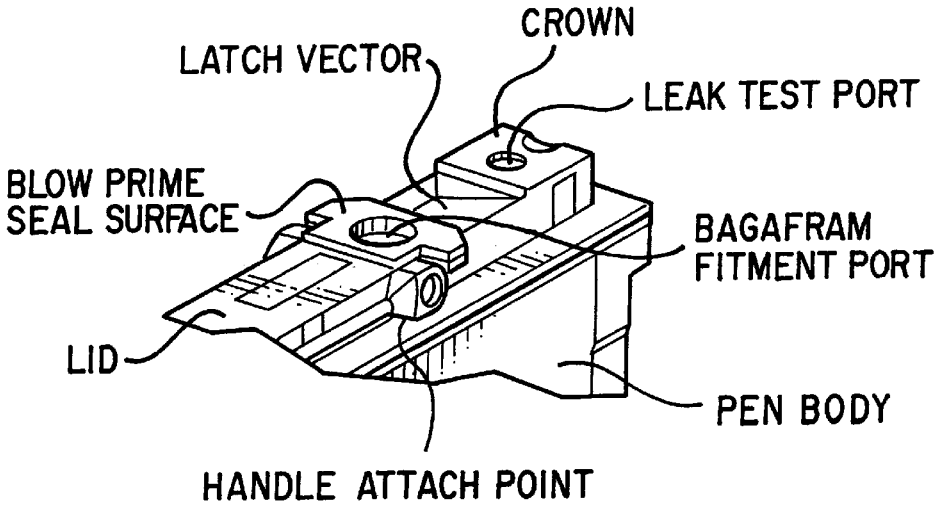
FIG. 7 shows a portion of the crown with the print cartridge handle removed.
Figure 8:
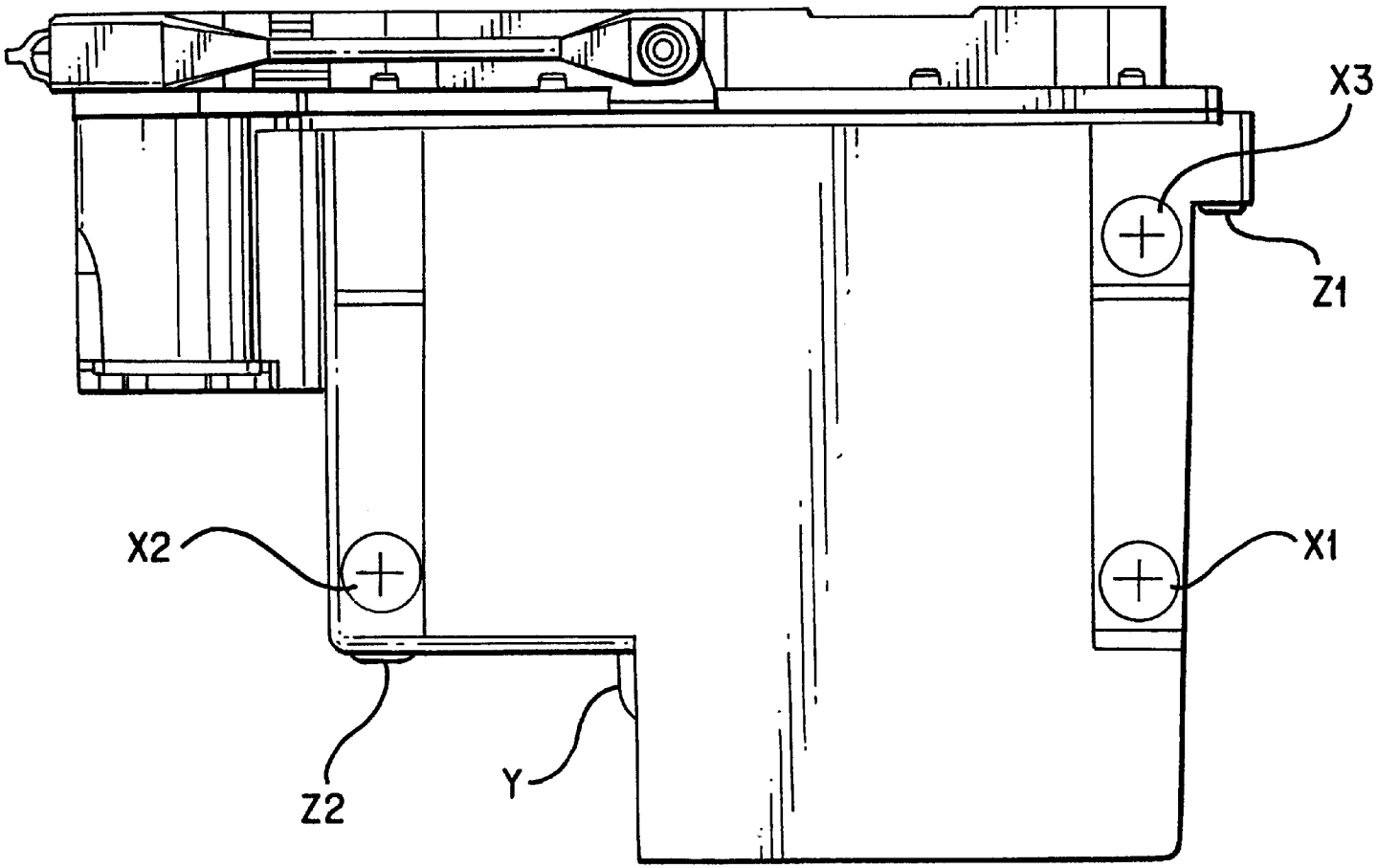
FIG. 8 is a side elevational view of the print cartridge with its handle down, and showing some of the datums.
Figure 9:
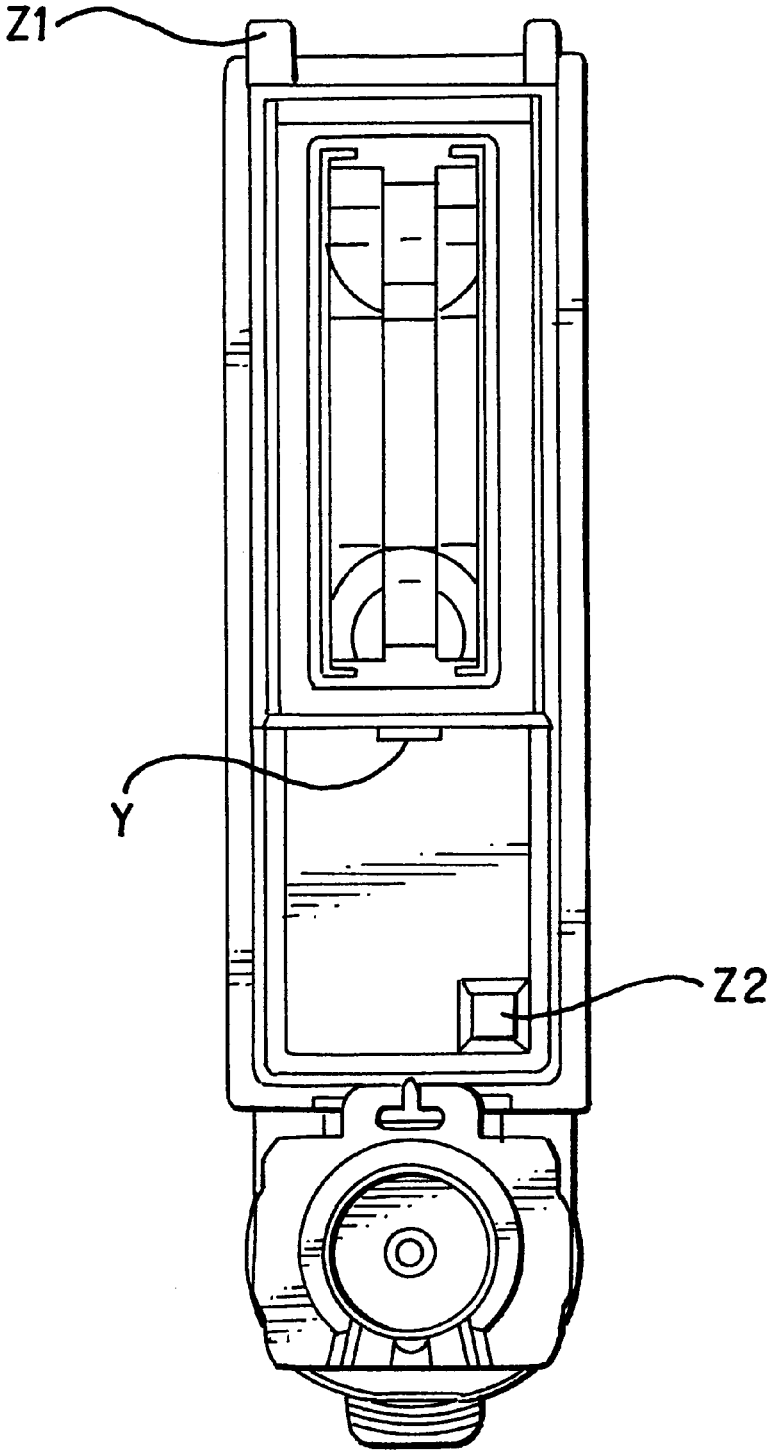
FIG. 9 is a bottom plan view of the print cartridge without its printhead and showing some of its datums.
Figure 10:
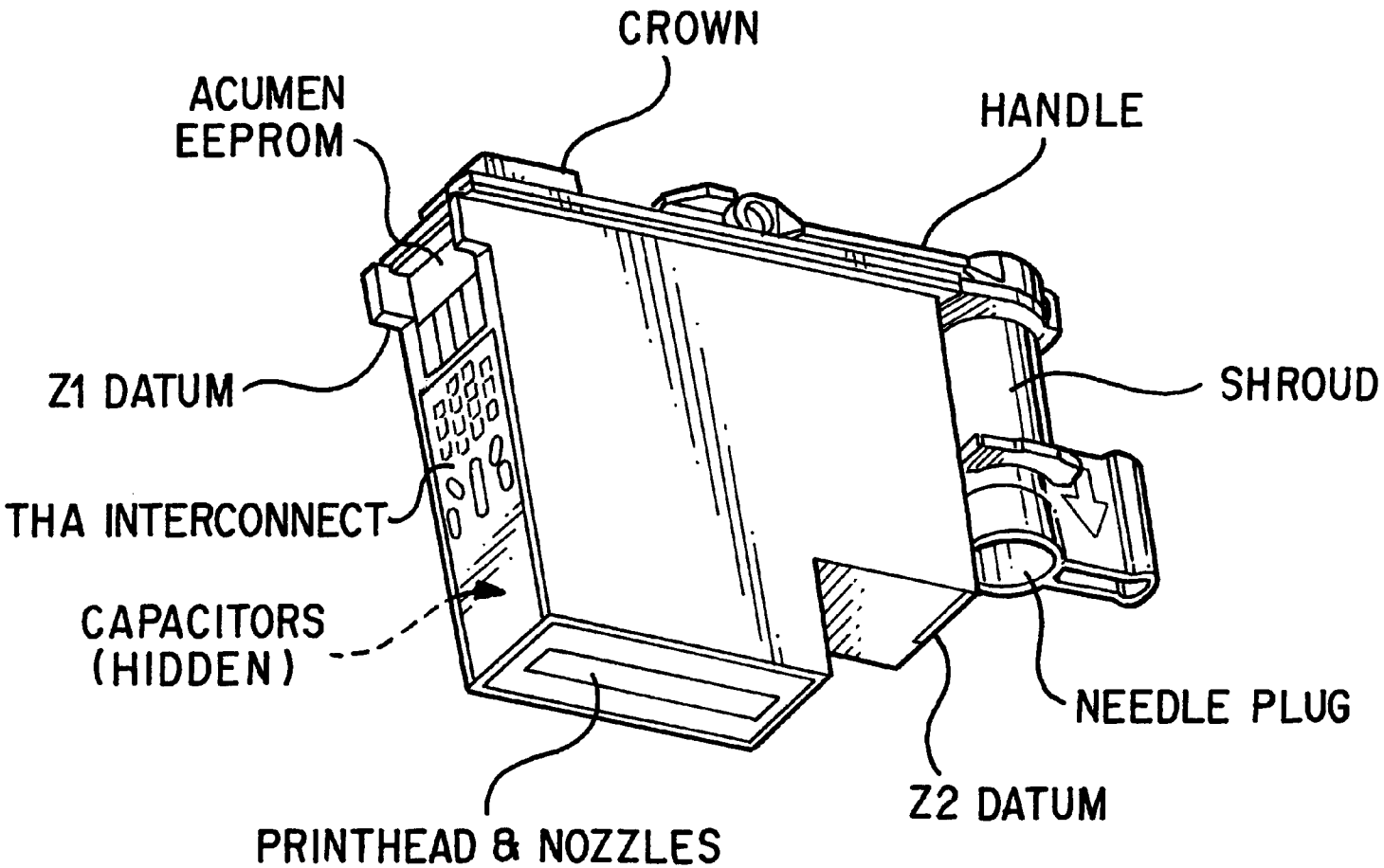
FIG. 10 is is bottom perspective view of the print cartridge of FIG. 6 showing some of the datums, the printhead and the electrical interconnect.

FIGS. 2 and 5 illustrate details of carriage 16, and includes pen stalls 76, 78, 80, 82. Pens 28, 30, 32, 34 are installed into stalls 76, 78, 80 82, respectively. Stall 76 is typical and will be described in detail. Stall 76 includes X, Y, and Z datums that correspond directly with the X, Y, and Z datums on pen 28, described in reference to FIGS. 3 and 4. For example, in FIG. 2, X datums 84, 86 and Z datum 90 are visible in stall 78, which datums correspond to the datums on pen 30. Stall 76 also includes contact pads 96 and notch 100. A spring is positioned behind contact pads 96 to bias the contact pads outward or in the direction of the notch 100.

As pen 28 is installed into stall 76, neck 58 fits into notch 100. As the pen is further installed, spring 98 urges the pen toward the right (as viewed in FIGS. 3 and 4) to bias X pen datums 60, 62, and 64 against the X carriage datums to position the pads in the X direction within the carriage. Carriage contact pads 96 engage with pen contact pads 52, so that the printer can commnunicate with the pen. Also, because of the spring behind contact pads 96, Y pen datum 70 is urged against its carriage datum to position the pen in the Y direction. By means of a latch mechanism described below, Z pen datums 66 and 68 are urged against the Z carriage datums to position the pen in the Z direction. Thus the pen is precisely positioned in the X, Y, and Z directions with respect to carriage 16 so that droplets arm accurately deposted on the page in their intended location.

FIG. 2 illustrates details of the latching mechanism that latches pens 28, 30, 32, and 34 into their respective stalls so that the pen datums are all firmly held into position against their respective carriage datums. This mechanism includes a carriage chassis 110, latch 112, handle 114, and pivot arm 116. Carriage chassis rides along carriage rod 14 at hole 118. A set of contact arms 120 is pivotally connected to latch 112, as shown, and a spring (not shown) is mounted behind each of contact arms 120 to urge contact arms 120 outward or away from latch 112. Handle 114 includes a hook 124, designed to interlock with pivot arm 116, as described below. Latch 112 is pivotally attached to carriage chassis 110, and handle 114 is in turn pivotally attached to latch 112, as shown. Pivot arm 116 is pivotally attached to carriage chassis 110, as shown.

FIG. 2 shows the latch mechanism in its fully open position, with latch 112 flipped back toward the rear of the printer and handle 114 rotated back behind latch 112. Pivot arm 116 is rotated forward out of the way. With the latch mechanism in this position, pens can be installed or exchanged. Handle 114 is rotated so that hook 124 is interlocked with pivot arm 116. The user rotates handle 114 back toward the rear of the printer (counterclockwise as viewed in FIG. 2). As the handle is thus rotated, latch 112 will be urged downward so that contact arms 120 are urged against the pens by means of springs mounted behind each contact arm.

in accordance with the design objectives, manifold 46 has various barriers, walls and clips to channel the ink tubes. Tube 172 carries black ink, tube 174 carries cyan ink, tube 176 carries magenta ink, and tube 178 carries yellow ink. Each of the tubes has a different length, and the different lengths of the tubes assists in the assembly of the tubes and valves in the manifold 46. The valves 132, 134, 136, 138 are connected to tubes 172, 174, 176, 178, respectively before the tubes are inserted in the manifold.

The process for installing pens is now described. This description is given with regard to pen 28, with the understanding that the process for installing the other pens is the same. The user gasps one pen 28 with the needle and printing nozzles facing down as shown in FIG. 3 and begins to position it within its stall 76. Pen 28 is positioned so that pen contact pads 52 are closest to carriage contact pads 96. Spring 98 has a high spring tension and urges pen 28 to the right as viewed in FIG. 2. Because of the spring behind carriage contact pads 96, contact pads 96 also urge pen 28 toward the front of stall 76 (i.e., toward notch 100). Because of the frictional forces between the pen and the walls of the stall, the user will need to use some force to push the pen downward into its stall.

As the user further pushes pen 28 into its stall, neck 58 will engage within and interface with notch 100. As this happens, notch 100 positions shroud 56 over valve 132. As the user further pushes ten pen down, shroud 56 will engage with valve 132 to locate valve 132 within shroud 56 and also positions needle 54 above septum and in position to pierce slit 150.

FIGS. 11–15 show additional details of one embodiment of the compact print cartridge and the ink supply interconnect from the flexible tubes to the printheads.

Figure 11:
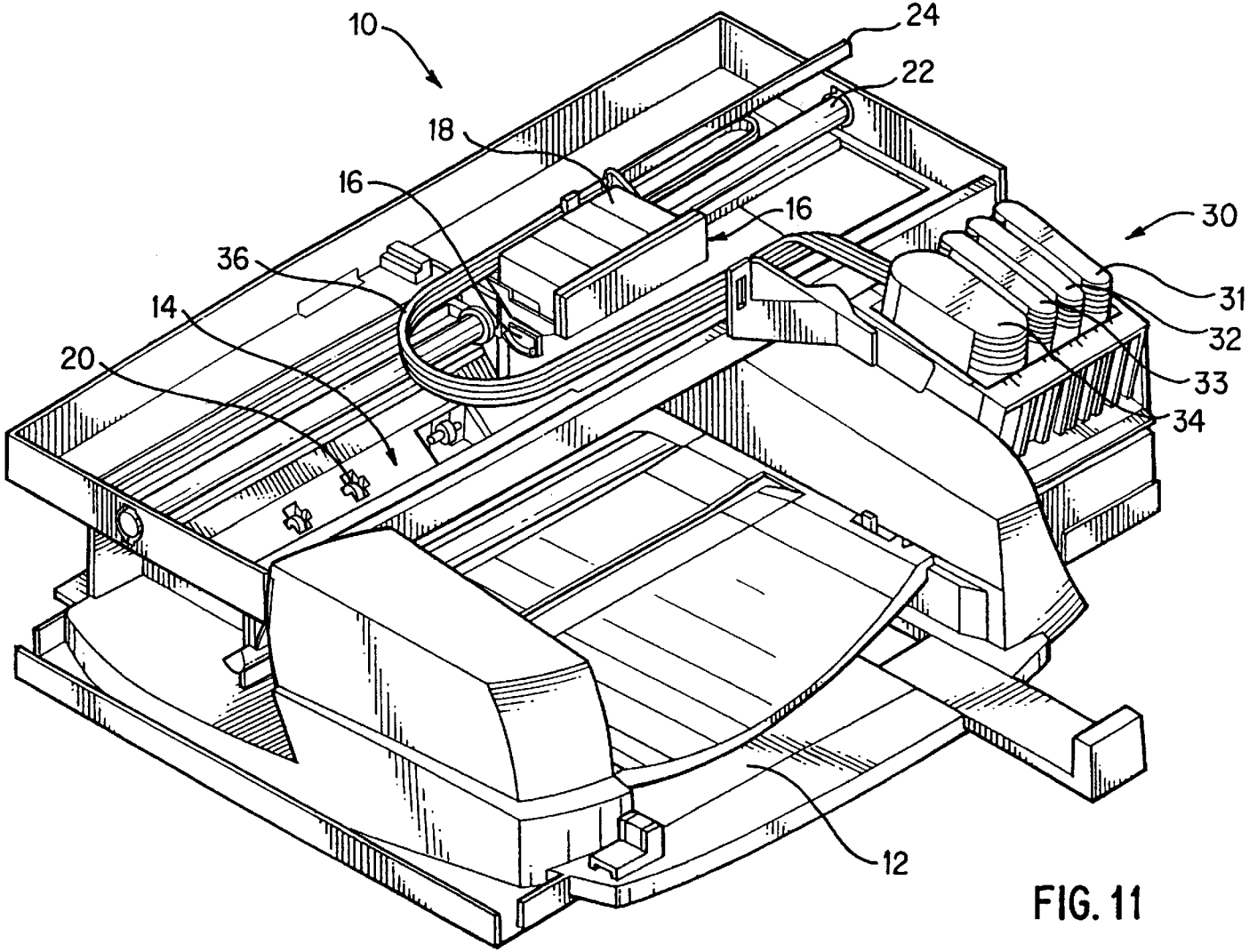
FIG. 11 is another view of the inkjet printer of FIG. 1 with the print carriage in the print zone.

FIG. 11 is a perspective view of one embodiment of an inkjet printer 510, with its cover removed, incorporating various inventive features. Generally, printer 510 includes a tray 512 for holding virgin paper. When a printing operation is initiated, a sheet of paper from tray 512 is fed into the printer using a sheet feeder, then brought around in a U direction to now travel in the opposite direction toward the tray. The sheet is stopped in a print zone 514, and a scanning carriage 516, containing one or more print cartridges 518, is then scanned across the sheet for printing a swath of ink thereon.

After a single scan or multiple scans, the sheet is then incrementally shifted using a conventional stepper motor and feed rollers 520 to a next position within print zone 514, and carriage 516 again scans across the sheet for printing a next swath of ink. When the printing on the sheet is complete, the sheet is forwarded to a position above tray 512, held in that position to ensure the ink is dry, and then released.

The carriage 516 scanning mechanism may be conventional and generally includes a slide rod 522, along which carriage 516 slides, and a coded strip 524 which is optically detected by a photodetector in carriage 516 for precisely positioning carriage 516. A stepper motor (not shown), connected to carriage 516 using a conventional drive belt and pulley arrangement, is used for transporting the carriage across the print zone.

Figure 12:
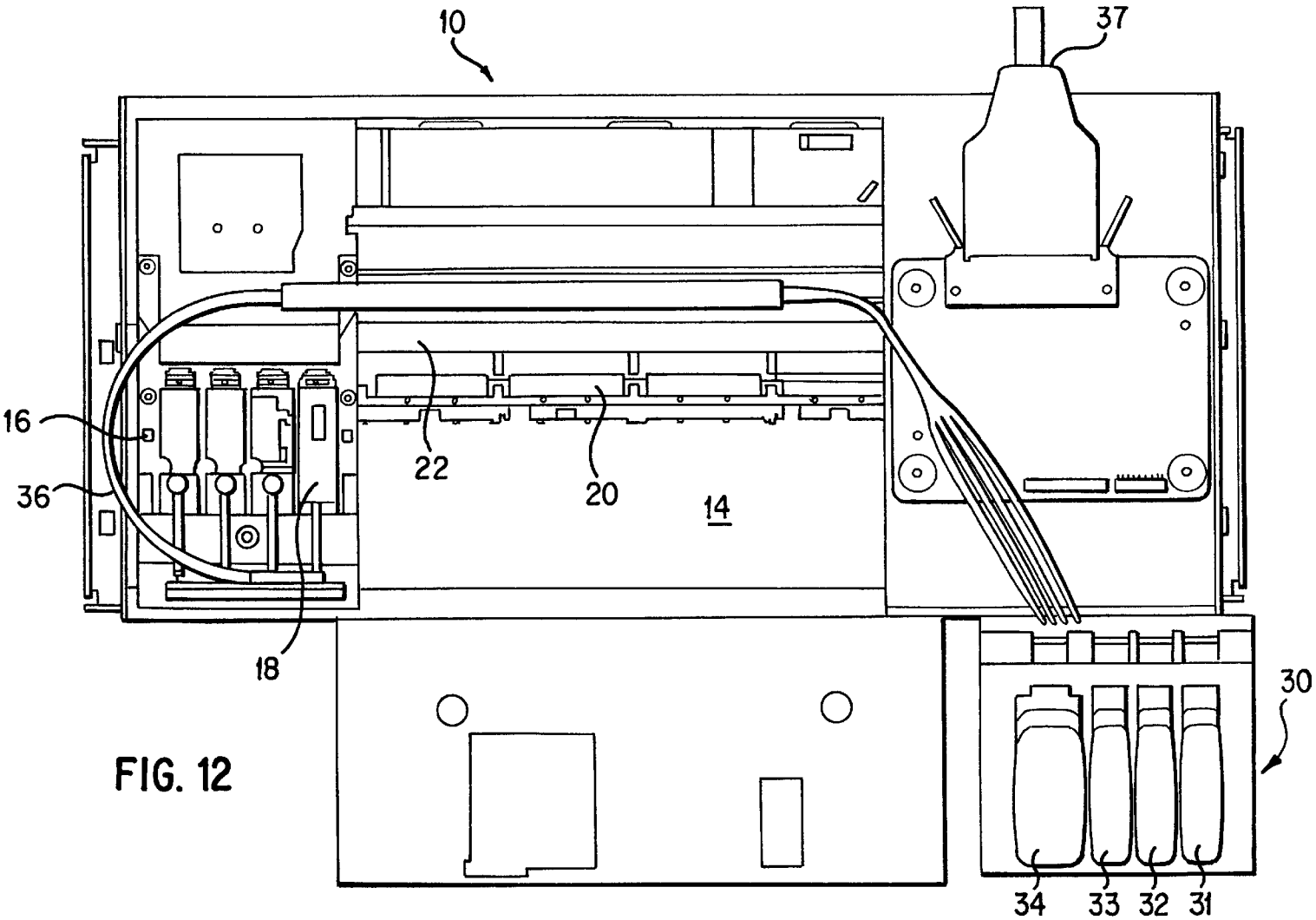
FIG. 12 is a top plan view of another version of an inkjet printer having ink replenishment tubes connected to the print cartridges in the carriage.

FIG. 12 is a top down view of another printer very similar to that shown in FIG. 11, but with the paper tray removed. An electrical connector 537 is shown connected between printer and a personal computer. Elements throughout the various figures identified with the same numerals may be identical.

This ink delivery system includes an off-axis ink supply station 530 containing replaceable ink supply cartridges 531, 532, 533, and 534, which may be pressurized or at atmospheric pressure. For color printers, there will typically be a separate ink supply cartridge for black ink, yellow ink, magenta ink, and cyan ink.

Four tubes 536 carry ink from the four replaceable ink supply cartridges 531–534 to the four print cartridges 518. The four tubes 536, each connected to an ink supply cartridge, are in fluid connection with a rubber septum 552 for each of the four stalls in the carriage. A hollow needle 560 formed as part of each print cartridge is inserted through the rubber septum 552 upon pushing the print cartridge into its associated stall within the carriage so that a fluid communication path exists between a particular ink supply cartridge 542–545 and a particular print cartridge for providing a supply of ink to the print cartridge.

Figure 13A:
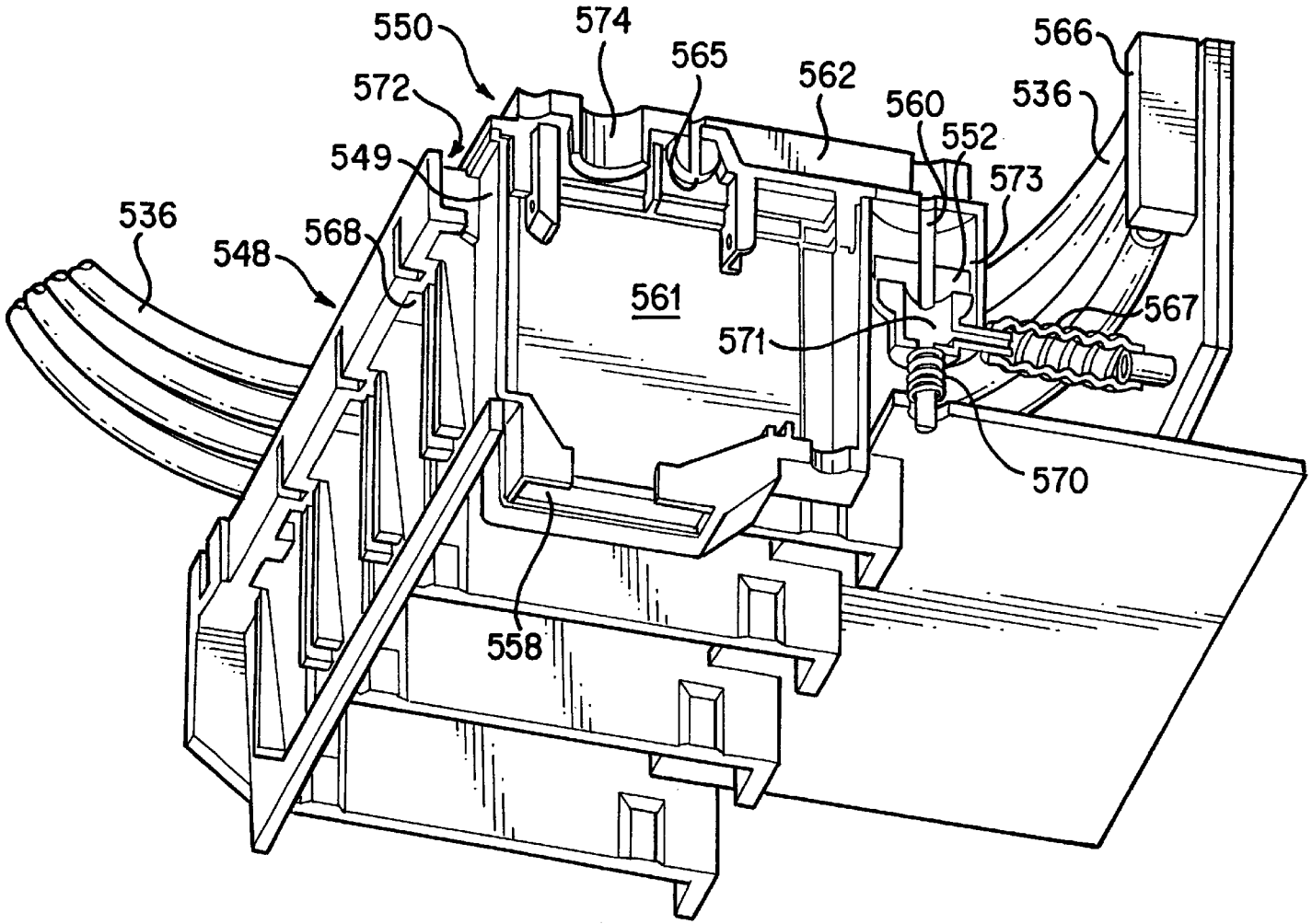
FIG. 13A is a bottom perspective view of a carriage having ink replenishment tubes and showing one pint cartridge in cross section.

FIG. 13A is a perspective view looking up at carriage 548, showing print cartridge 550 and septum 552 in cross-section. This cross-section does not show a regulator valve within print cartridge 550 that regulates pressure by opening and closing hole 565. An opening in the bottom of carriage 548 exposes the printhead location 558 of each print cartridge 550. Carriage electrodes oppose contact pads located on print cartridge 550.

When the aforementioned regulator valve is opened, a hollow needle 560 is in fluid communication with an ink chamber 561 internal to print cartridge 550. The hollow needle 560 extends through a self-sealing slit formed through the center of septum 552. This self-sealing slit is automatically sealed by the resiliency of the rubber septum 552 when needle 560 is removed.

A plastic ink conduit 562 leads from needle 560 to ink chamber 561 via hole 565. Conduit 562 may also be integral to the print cartridge body. Conduit 562 may be glued, heat-staked, ultrasonically welded, or otherwise secured to the print cartridge body.

A septum elbow 571 routes ink from manifold 566 to septum 552 and supports septum 552. Septum 552 is affixed to elbow 571 using a crimp cap 573.

A bellows 567 (shown in cross-section) is provided for each of the individual stalls 568 for allowing a degree of x, y, and z movement of septum 552 when needle 560 is inserted into septum 552 to minimize the x, y, and z load on needle 560 and ensure a fluid-tight and air-tight seal around needle 560.

A spring 570 urges septum 552 upward. This allows septum 552 to take up z tolerances, minimizes the load on needle 560, and ensures a tight seal around needle 560. Slots 572 formed on each of the stalls 568 in carriage 548 align with tabs on each print cartridge 550 to restrict movement of the print cartridge 550 within the stall 568. An air vent 574 formed in the top of print cartridge 560 is used by a pressure regulator in print cartridge 550.

Figure 13B:
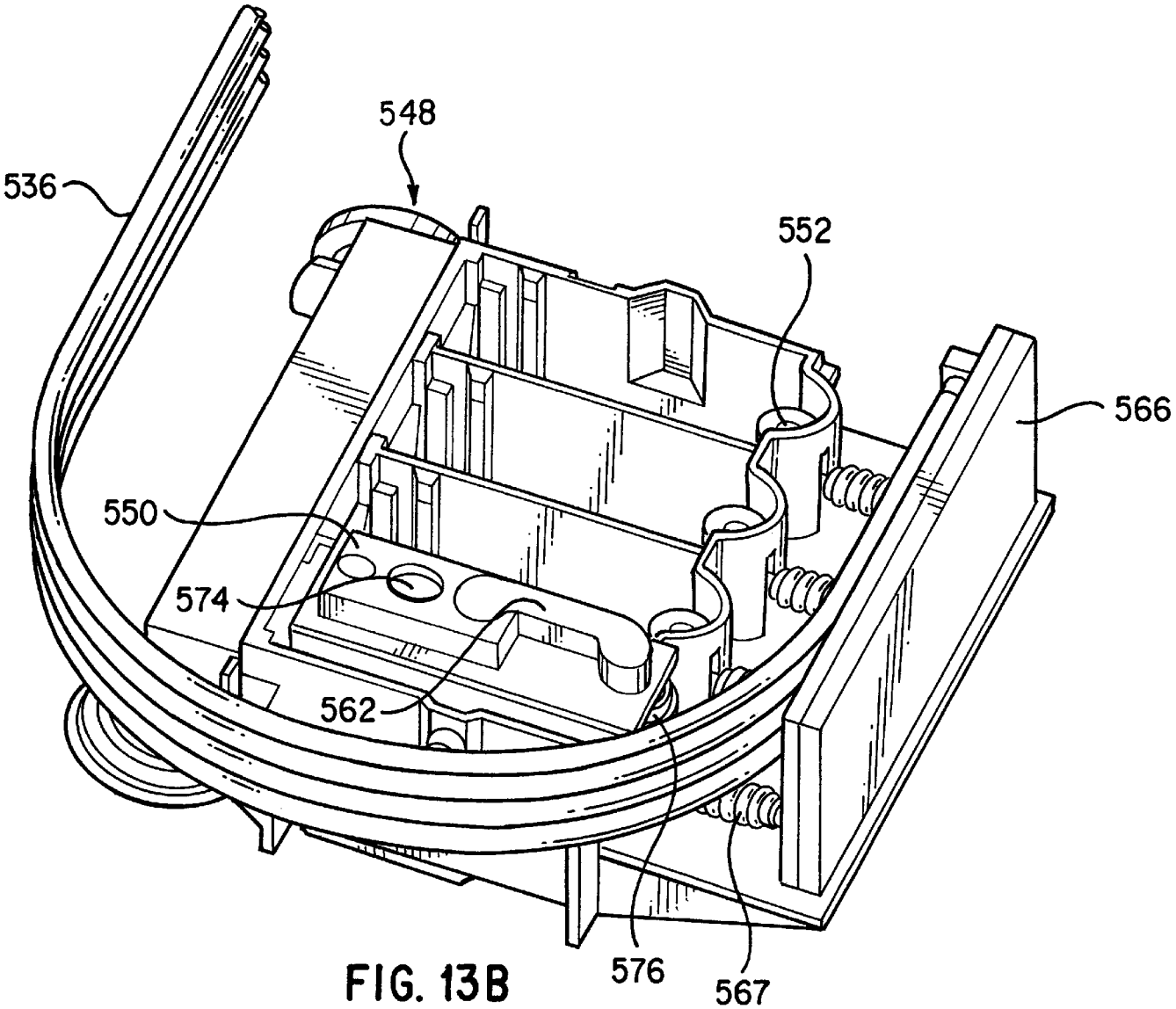
FIG. 13B is a top perspective view of the carriage of FIG. 13 with one print cartridge installed.

FIG. 13B is a perspective view of carriage 548 looking down on carriage 548 and showing one print cartridge 550 installed.

If desired, the print cartridges can be secured within the scanning carriage by individual latches, which may be manually operated or spring loaded, where the latches press down on a tab or a comer of the print cartridge. In the presently preferred embodiment, a single latch, such as a hinged bar, secures all four print cartridges in place within the carriage.

Figure 14:
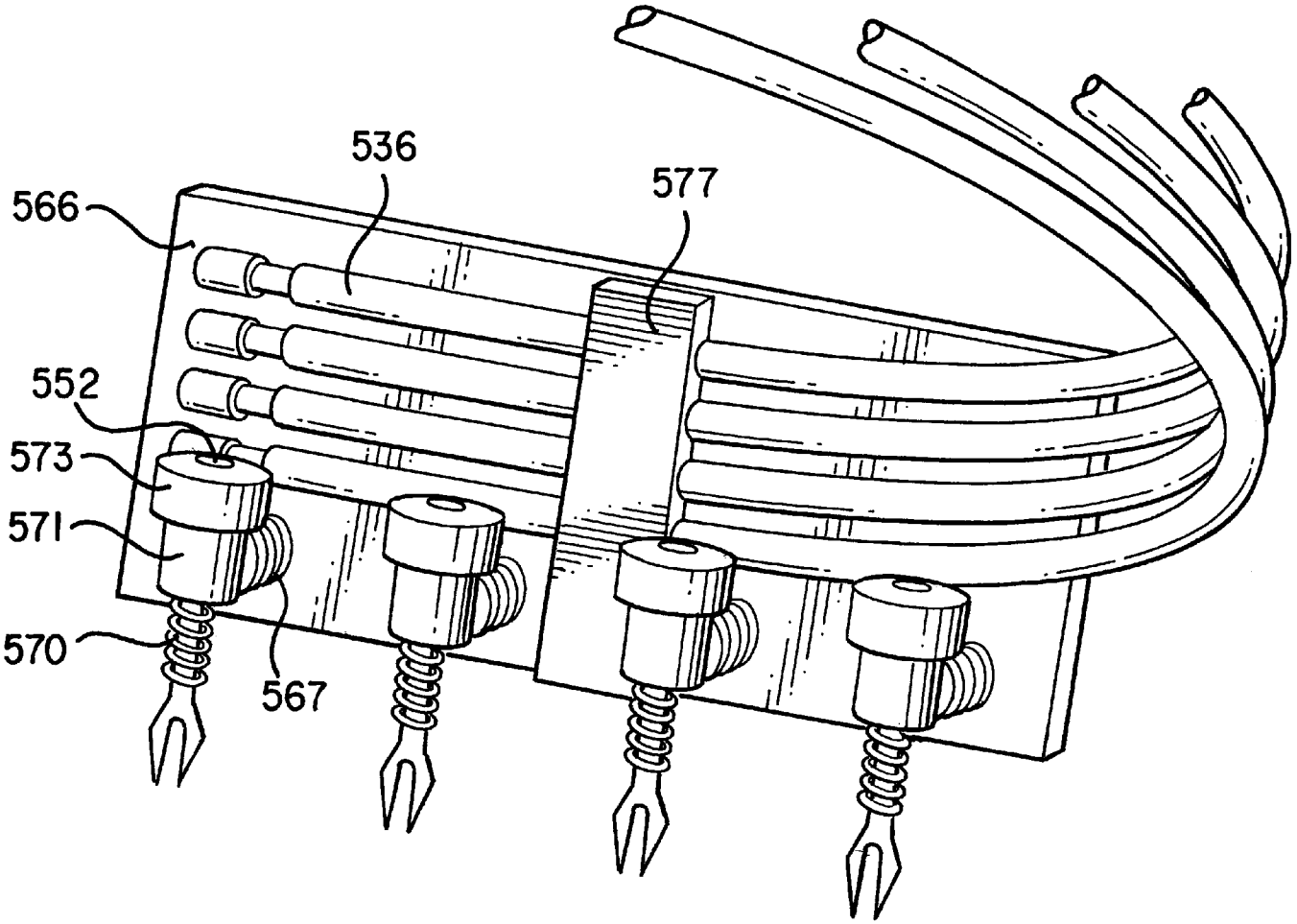
FIG. 14 shows the details of the ink replenishment valve system for the carriage.

FIG. 14 is a detailed view of manifold 566, tubes 536, crimp cap 573, septum 552, septum elbow 571, spring 570, and bellows 567 described with respect to FIG. 13A. A stress reliever 577 for tubes 536 is also shown.

Figure 15A:
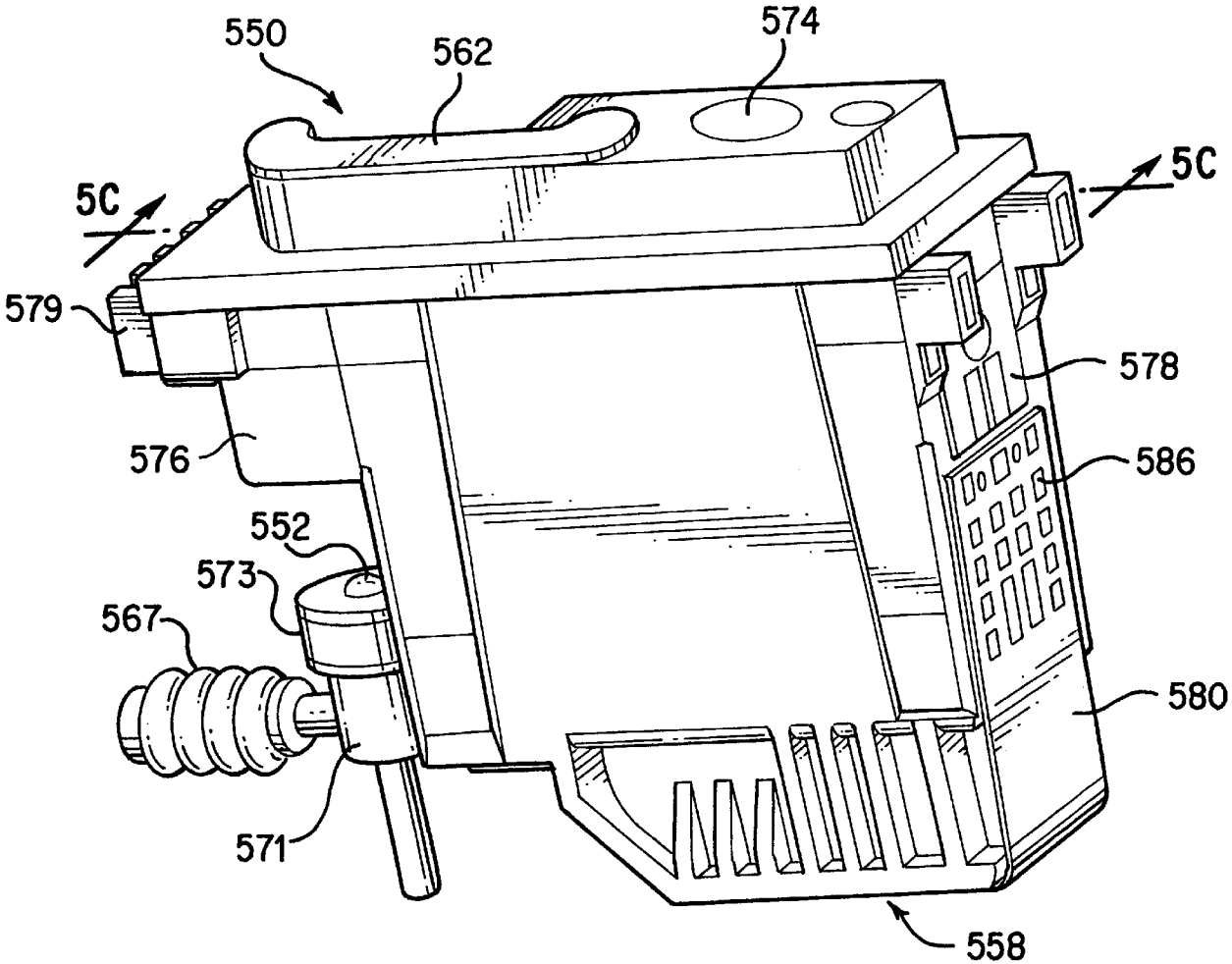
FIGS. 15A and 15B show two different fluid interconnects to a print cartridge.

FIG. 15A is a perspective view of a presently preferred embodiment of print cartridge 550. A shroud 576 surrounds needle 560 (obscured by shroud 576) to prevent inadvertent contact with needle 560 and also to help align septum 552 with needle 560 when installing print cartridge 550 in carriage 548.

A flexible tape 580 containing contact pads 586 leading to the printhead substrate is secured to print cartridge 550. These contact pads 586 align with and electrically contact electrodes 549 on carriage 548. Preferably, the electrodes on carriage 548 are resiliently biased toward print cartridge 550 to ensure a reliable contact.

The printhead nozzle array is at location 558. An integrated circuit chip 578 provides feedback to the printer regarding certain parameters of print cartridge 550.

Figure 15B:
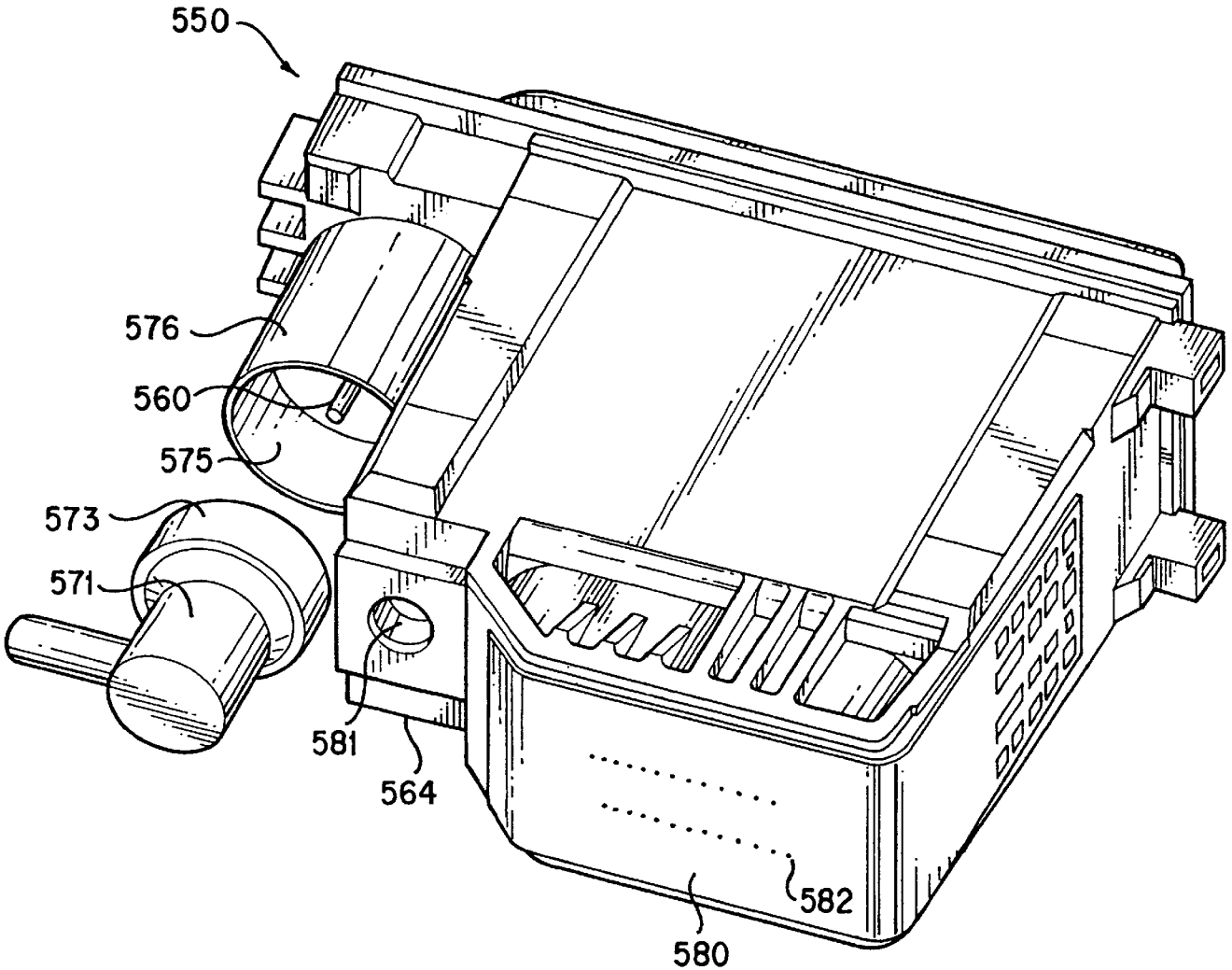

FIG. 15B illustrates the bottom side of print cartridge 550. Two parallel rows of offset nozzles 582 are shown laser ablated through tape 580. An ink fill hole 581 is used to initially fill print cartridge 550 with ink. A stopper (not shown) is intended to permanently seal hole 581 after the initial filling.

Figure 15C:
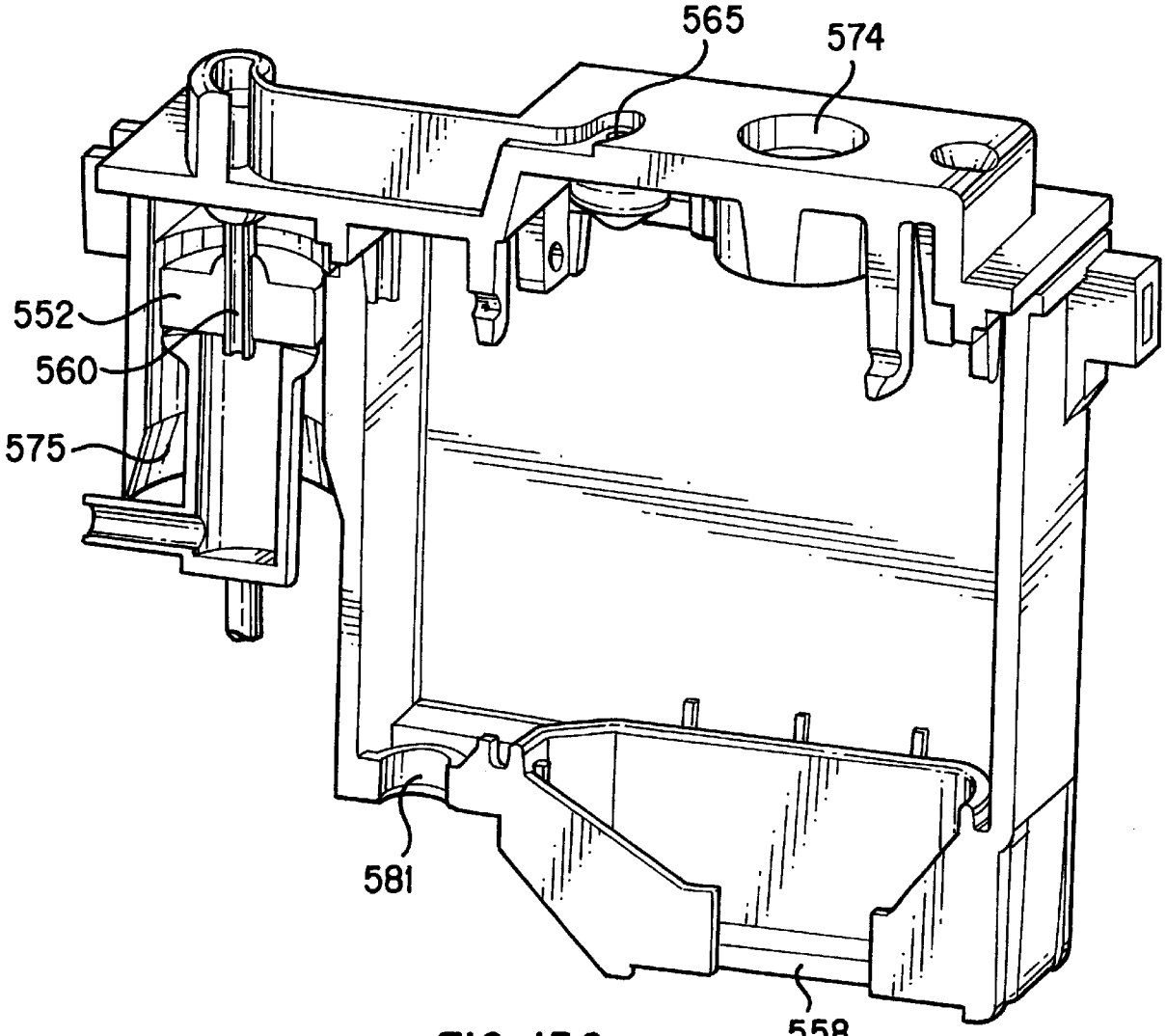
FIG. 15C is a cross-sectional view of the print cartridge of FIG. 15B now connected to the fluid interconnect on the carriage.

FIG. 15C is a cross-sectional view of print cartridge 550, without tape 580, taken along line 15C–15C in FIG. 15A. Shroud 576 is shown having an inner conical or tapered portion 575 to receive septum 552 and center septum 552 with respect to needle 560.

The print cartridges and ink supply connections described thus far are down-connect types where the ink connection is made when pressing the print cartridge down into the carriage. This enables a resulting printer to have a very low profile since the ink path does not extend above the print cartridge. In various embodiments shown having the needle extending from the print cartridge, the needle may be replaced with a septum, and the septum on the scanning carriage replaced with a hollow needle.

Figure 16:
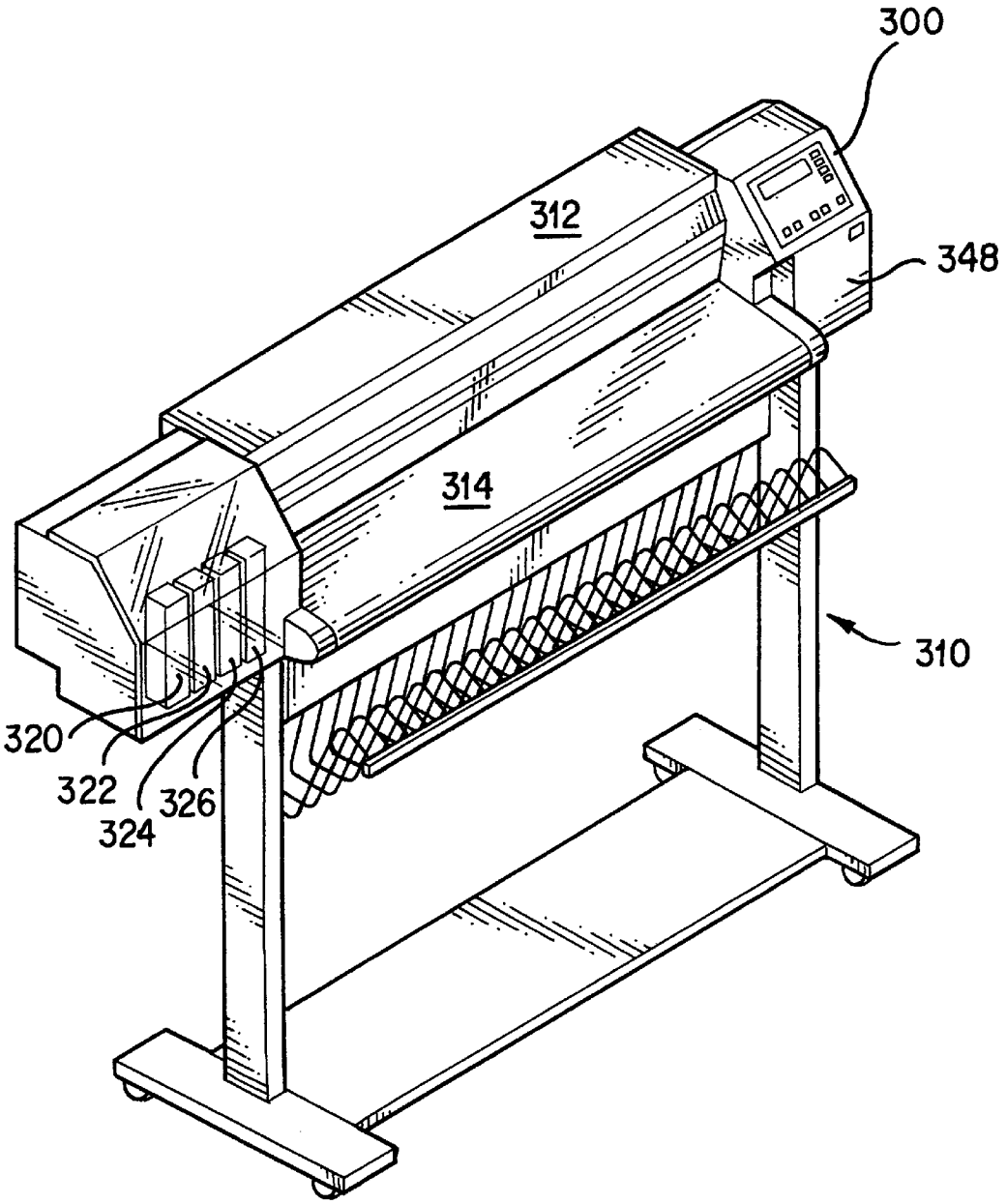
FIG. 16 is a perspective view of a large format inkjet printer incorporating the printhead of FIGS. 6–10.

FIG. 16 shows a large format printer 310 of the type which includes a transversely movable printhead carriage enclosed by a cover 312 which extends over a generally horizontally extending platen 314 over which printed media is discharged into a catcher basket. At the left side of the platen are four removable ink reservoirs 320, 322, 324, 326 which, through a removable flexible tube arrangement to be described, supply ink to four inkjet printheads mounted on the moveable carriage.

The recent embodiment of the unique compact print cartridge in its presently preferred embodiment is employed in a large format rollfeed/sheet feed printer. While some of the features are closely similar to the earlier embodiment shown in FIGS. 3–4 and other related FIGS., new reference numerals will be used for clarification. In that regard, the print cartridge 602 includes a body 603 which forms an internal reservoir and a lower snout 604 which extends more than half the distance across a lower end of the internal reservoir and defines a nozzle area 606 from which ink is applied to media. An upper crown 608 includes on one end (generally above the snout) a leak test hole 610, a slanted vector force contact area 612, and a vent hole 614 to the valve-actuator bellows surrounded by a primer seal area 615. The other end of the crown includes a lid 616 which covers an enclosed passage connecting the fluid interconnect 618 with an inlet valve to the internal reservoir, and a peripheral ledge 619 which provides a recess for receiving a handle 620 in its down position. The fluid interconnect includes a shroud 622 surrounding a downwardly projecting needle 623 which is protected by a plug 624 during shipment and before installation in the carriage. A color keying component 626 is used to assure that each print cartridge is installed in its proper chute or slot in the carriage.

The datums on the print cartridge include three X datums 630, 632, 634, one Y datum 636 and two Z datums 638, 640 as shown in the FIGS. which are arranged to assure proper and secure positioning against matching datums surfaces in the carriage. In contrast to some earlier print cartridges, these datums need not be machined in order to avoid mis-alignment.

The handle 620 includes enlarged hubs 650 which are pivotally mounted on pins 652. The hubs are at each end of two small diameter legs 654 which join together to form a thickened loop 656 having an outwardly extending tab 658.

It will be understood from the foregoing description and accompanying drawings that the print cartridge of the present invention provides a set of unique mechanical interface features that enable high performance printheads (sometimes referred to herein as "pens") designed to receive ink from separable external ink supplies while maintain a compact printer form factor. This feature set includes a novel combination of outside form factor, datum arrangement, latching, and handle which have been matched with corresponding features in the carriage to facilitate print cartridge installation, printing, servicing, removal and replacement while maintaining predictable and precise tolerances around the required fluid and electrical interconnections.

The lower height dimension serves to minimize the overall printer height, and allows a printer to be stored and/or used in typical nineteen inch rack mountable hardware. The minimal width serves to diminish the eight-times multiplier effect caused by a four printhead carriage overtravel on each end of the carriage scan. Depth has the least impact on the product size, and in fact the additional depth helps to provides better theta-z rotational control of the print cartridges mounted in the carriage.

Weight is important to minimize motor force requirements which has a direct impact on product cost. Also, printers using heavier print cartridges often generate objectionable shaking and vibrations when used on a high performance carriage which has an increased range of acceleration/deceleration at both ends of the scan.

The following table shows the changes for the new 600 dpi printhead of the present invention as compared to a typical previous 600 dpi printhead of Hewlett-Packard:

TABLE I

| | # of Nozzles | Height | Width | Depth | Weight with ink |
|---|---|---|---|---|---|
| Old Spring-Bag | 300 | 93 mm | 18.7 mm | 60 mm | 113 gms |
| New Compact Size | 512 | 51 | 15.9 | 70 | 38 gms |

The improved datum arrangement has been developed in order to successfully implement the small form factor and to assure precise positioning during the life of a semi-permanent print cartridge and printhead. In this regard, the datum arrangement minimizes undesirable theta-z variations. Also, the datum locations are spaced apart as much as possible from the printhead itself to minimize any adverse effect of datum engagement generated particles on successful ink ejection from the printhead.

The position of the latch force vector minimizes alignment variation for a small form factor print cartridge. The latch applies a force of the top of the print cartridge that passes between the fluid and electrical connections to the printhead. The fluid and electrical connections are made at opposing ends of the print cartridge. The latch force vector is applied at a point between these connections, and in a preferred embodiment is applied at a point that is proximate to the intersection of a plane that bisects the nozzle plane and passes through the top of the print cartridge. The exact predetermined location for applying the latch force minimizes the overall force required to accurately position this small form factor print cartridge. Moreover, if there is a printhead/media crash that knocks the print cartridge out of alignment, the latch mechanism in combination with the datums will tend to correctly reseat the print cartridge in that carriage.

While particular exemplary embodiments have been shown and described, it will be appreciated by those skilled in the art that various changes, substitutions and improvements can be made without departing from the spirit and scope of the invention as set forth in the following claims.

We claim as our invention:

1. A printhead mountable in a carriage and adapted to being supplied with liquid ink without removal of said printhead from the carriage, comprising:

an inkjet printhead;

a housing for carrying said printhead and thereby forming a print cartridge;

a reservoir inside of said housing;

a plurality of ink ejection chambers in said printhead and in communication with said reservoir;

an inlet located on a first outer portion of said housing and in communication with said reservoir for connection with an external ink supply; and an electrical interconnect located on a second outer portion of said housing for receiving control signals to activate said ink ejection chambers, with said electrical interconnect and said inlet located on oppositely facing sides of said housing.

2. The printhead of claim 1 which further includes a nozzle member on a third outer portion of said housing adjacent to said plurality of ink ejection chambers in order to pass ink in said ejection chambers from said ejection chambers onto media, said nozzle member located in a facing position different from said oppositely facing sides of said body.

3. The printhead of claim 2 wherein said facing position of said nozzle member is approximately perpendicular to said oppositely facing sides of said body.

4. The printhead of claim 2 wherein said body includes a central section having a central section depth and which incorporates said reservoir and said electrical interconnect; and wherein said body includes a snout section which incorporates said ejection chambers and said nozzle member, with said snout section having a certain depth which is less than said depth of said central section.

5. The printhead of claim 4 wherein said certain depth of said snout section is greater than half of said depth of said central section.

6. The printhead of claim 4 wherein said nozzle member has more than 200 nozzle orifices and said certain depth of said snout section accommodates said nozzle member.

7. The printhead of claim 4 wherein said nozzle member has more than 300 nozzle orifices, and said certain depth of said snout section accommodates said nozzle member.

8. The printhead of claim 4 wherein said nozzle member has more than 400 nozzle orifices, and said certain depth of said snout section accommodates said nozzle member.

9. The printhead of claim 4 wherein said nozzle member has more than 500 nozzle orifices, and said certain depth of said snout section said nozzle member.

10. The printhead of claim 4 wherein said nozzle member has a plurality of nozzle orifices having a nozzle resolution greater than 150 per inch, and said certain depth of said snout section accommodates said nozzle member.

11. The printhead of claim 4 wherein said nozzle member has a plurality of nozzle orifices having a nozzle resolution greater than 300 per inch, and said certain depth of said snout section accommodates said nozzle member.

12. The printhead of claim 4 wherein said nozzle member has a plurality of nozzle orifices having a nozzle resolution greater than 600 per inch, and said certain depth of said snout section accommodates said nozzle member.

13. The printhead of claim 1 wherein the overall height of the printhead cartridge is approximately 50 mm or less.

14. The printhead of claim 1 wherein the overall width of the printhead cartridge is approximately 16 mm or less.

15. The printhead of claim 1 wherein the approximate weight of the printhead cartridge is approximately 50 grams or less.

16. The printhead of claim 1 which includes a supply of ink or other suitable liquid in said reservoir.

17. The printhead of claim 1 which includes an auxiliary reservoir connected to said inlet, and an external supply of ink or other suitable liquid in said auxiliary reservoir.

18. A printing device mountable in a carriage and adapted to being supplied with liquid without removal of said printhead from the carriage, comprising:

a printhead;

a housing for carrying said printhead thereby forming a print cartridge;

a reservoir inside of said housing;

a plurality of ejection chambers in said printhead and in communication with said reservoir;

an inlet located on a first outer portion of said housing and in communication with said reservoir for connection with an external supply of liquid; and an electrical interconnect located on a second outer portion of said housing for receiving control signals to activate said ejection chambers, with said electrical inter-connect and said inlet located on oppositely facing sides of said housing.

19. The printing device of claim 18 which includes a crown portion on top of said housing and incorporating an inlet valve to said reservoir, said inlet valve in fluid communication with said inlet.

20. The printing device of claim 19 which further includes a valve actuator inside said housing and coupled to said inlet valve, and wherein said crown portion includes a vent hole connected with said valve actuator in order to periodically open said inlet valve to allow replenishment of liquid to said reservoir.

21. The printing device of claim 18 which includes a supply of liquid in said reservoir.

22. The printing device of claim 18 which includes an auxiliary reservoir, and an external supply of suitable liquid in said auxiliary reservoir.

* * * * *

UNITED STATES PATENT AND TRADEMARK OFFICE

CERTIFICATE OF CORRECTION

PATENT NO. : 6,164,771
DATED : December 26, 2000
INVENTOR(S) : Eckard et al.

It is certified that error appears in the above-identified patent and that said Letters Patent is hereby corrected as shown below:

Column 10,
Line 41, after "said snout section" insert -- accomodates --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*